United States Patent [19]

Judice

[11] 3,967,826

[45] July 6, 1976

[54] GOLF PUTTER

[76] Inventor: Clay Judice, P.O. Box 2782, 222 Eraste Landry Road, Lafayette, La. 70501

[22] Filed: Dec. 30, 1974

[21] Appl. No.: 537,570

[52] U.S. Cl. ..... 273/167 F; 273/164; 273/167 A; 273/167 G; 273/80 C; 273/167 H

[51] Int. Cl.[2] ..... A63B 53/04

[58] Field of Search ..... 273/77 R, 78, 80 C, 273/164, 167–175; D34/5 GC, 5 GH

[56] References Cited

UNITED STATES PATENTS

| | | | |
|---|---|---|---|
| 1,705,250 | 3/1929 | Hincks | 273/164 |
| 2,174,212 | 9/1939 | Newsome | 273/164 |
| 3,077,350 | 2/1963 | Koorland | 273/80 C X |
| 3,448,981 | 6/1969 | Anweiler | 273/167 G X |
| 3,806,129 | 4/1974 | Burrows | 273/167 A X |
| 3,866,922 | 2/1975 | Marci et al. | 273/164 |
| D209,524 | 12/1967 | Mader | D34/5 GC |
| D216,031 | 11/1969 | Blake | 273/80 C X |
| D218,178 | 7/1970 | Solheim | 273/167 D X |
| D234,785 | 4/1975 | Mills | D34/5 GH |
| D234,858 | 4/1975 | Cook | D34/5 GH |
| D235,152 | 5/1975 | Mills | D34/5 GH |

FOREIGN PATENTS OR APPLICATIONS

| | | | |
|---|---|---|---|
| 211,781 | 12/1957 | Australia | 273/167 F |
| 238,646 | 10/1960 | Australia | 273/167 F |
| 371,974 | 5/1932 | United Kingdom | 273/167 F |
| 340,579 | 1/1931 | United Kingdom | 273/174 |
| 465,652 | 5/1937 | United Kingdom | 273/80 C |
| 1,063,798 | 3/1967 | United Kingdom | 273/167 A |

OTHER PUBLICATIONS

"Golf World;" May 4, 1971; p. 9.
"Golf Digest;" Apr. 1972; p. 107.
"Sports Illustrated;" Apr. 10, 1967; p. 69.

*Primary Examiner*—Richard J. Apley
*Attorney, Agent, or Firm*—LeBlanc & Shur

[57] ABSTRACT

Disclosed is a golf club having a shaft, a club head, and a shank connected between the shaft and head. The club head has a recess opening through the bottom thereof or in another form hereof to the rear side of the club head and which recess is disposed toward the heel portion of the head whereby the center of gravity of the club head lies outwardly of the club head median. In one form hereof, the flat striking surface of the club head lies in a plane generally parallel to a plane containing the shaft and a portion of the shank, such planes being spaced a distance substantially equal to the radius of the golf ball. The axis of the shaft lies in an oblique plane normal to the first-mentioned planes and the lower portion of the shank extends normal to such oblique plane for connection with the heel of the club head. The club is configured, weighted and balanced to provide a broad striking area with nominal or small variation in torque applied to the club when the ball is stroked. The club also provides for a symmetrical optical alignment of the club shaft, shank and head with the golf ball as well as a weighted alignment by balanced distribution of weight in the club. In another form, the recess is located such that a true vertical line extending through the center of the grip intersects the center of the club face to improve control of the ball when putting. A second cavity is located between the putter face and the first mentioned cavity to provide a uniform face depth assuring like reaction to the ball when struck to either side of the center or "sweet spot" of the club head.

5 Claims, 15 Drawing Figures

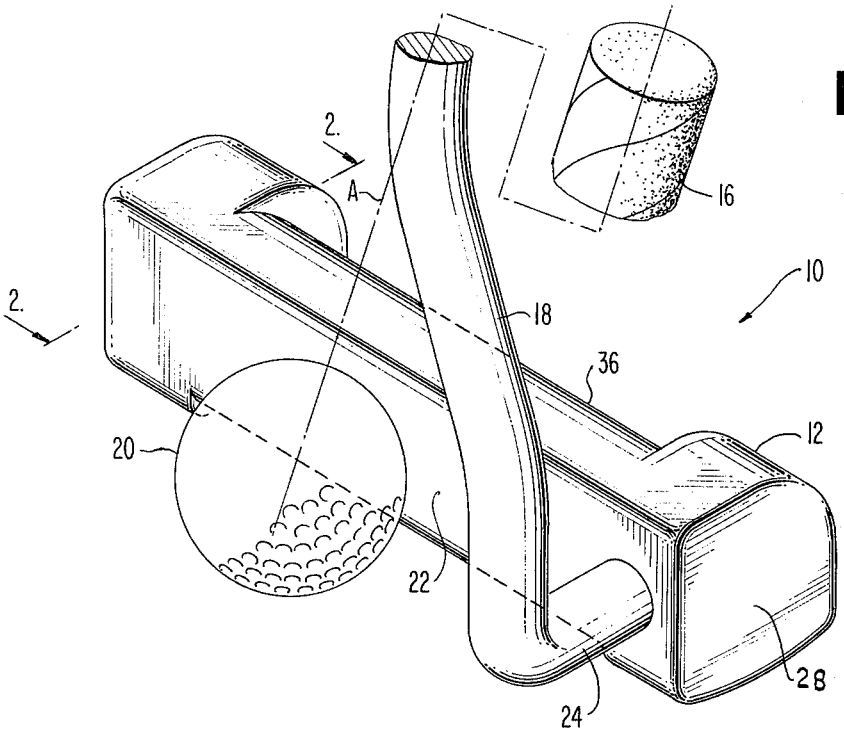
FIG. 1
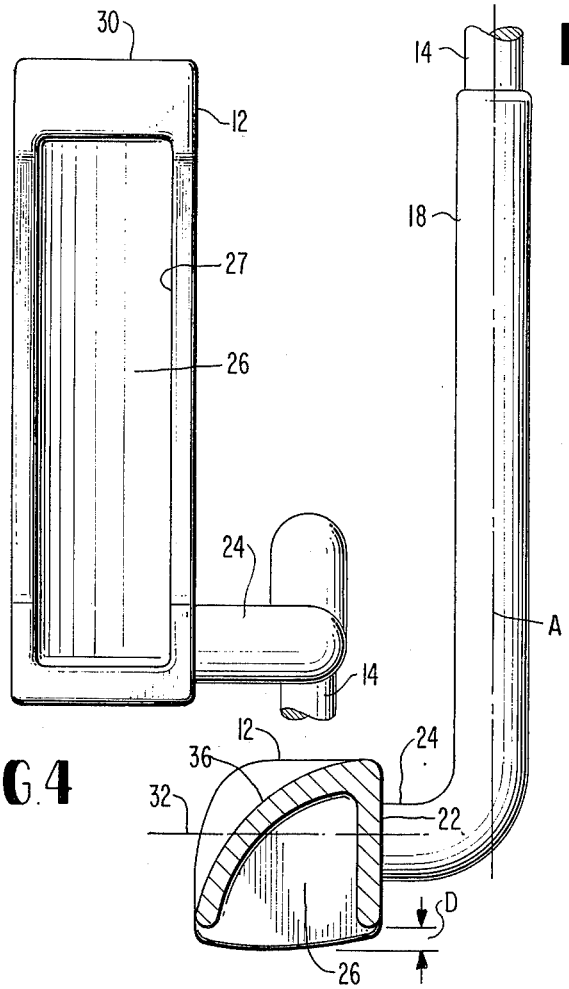
FIG. 2
FIG. 4
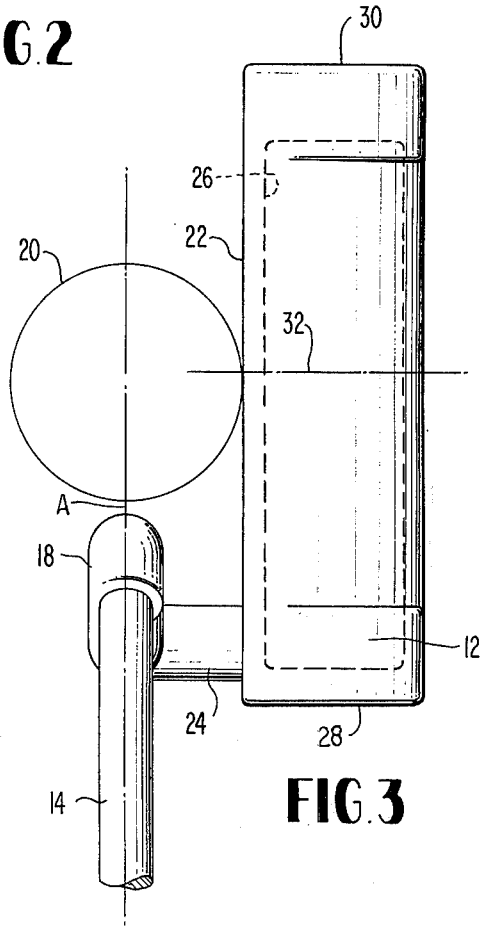
FIG. 3

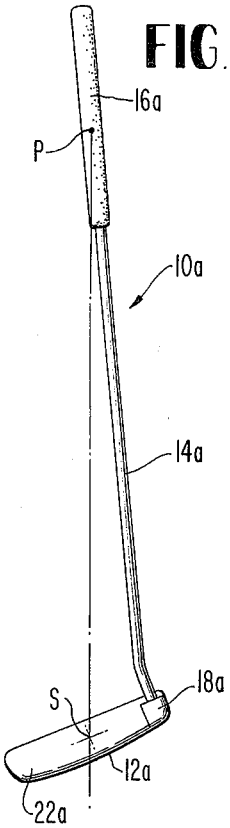
FIG.5
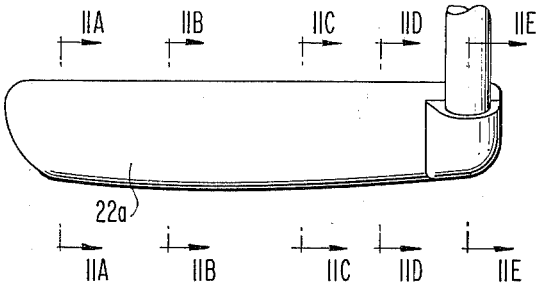
FIG.6
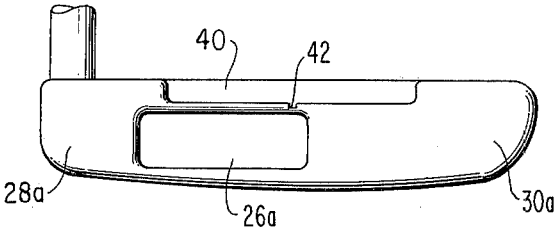
FIG.7
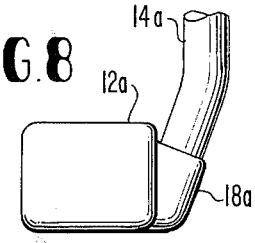
FIG.8
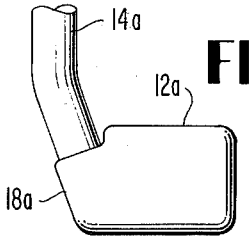
FIG.9
FIG.10
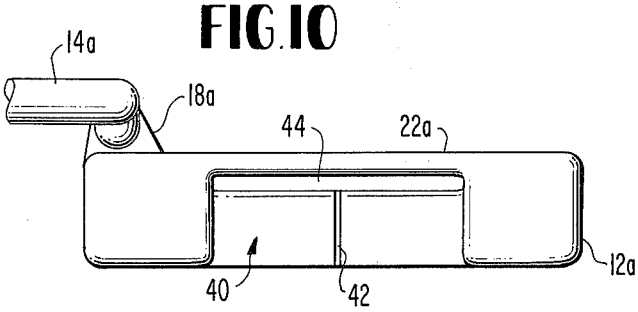
FIG.11D
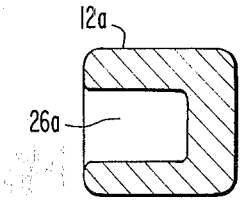
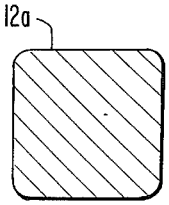
FIG.11A
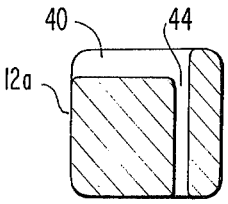
FIG.11B
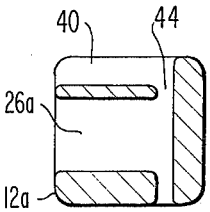
FIG.11C
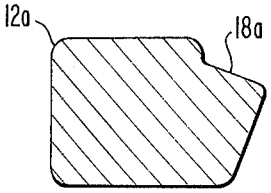
FIG.11E

GOLF PUTTER

The present invention relates to a golf club and more particularly relates to a novel and improved golf club putter for use on a golf putting green.

Many and various types of golf clubs and particularly golf putters have been proposed and constructed in the past. For example, U.S. Pat. No. 3,077,350; 3,387,844; and 3,448,981 disclose golf putters which are significantly different in configuration, construction, size, weight, dimensions, and action when the golf ball is stroked. The variations between the numerous putters proposed and constructed in the past are a result of designs based on scientific principle combined with personal preference.

The present invention provides a novel and improved golf club, particularly a golf putter, having various advantages in construction and use in comparison with such prior golf club putters and provides various novel and improved features of construction, alignment and action, between the club and ball when stroking. For example, the present golf putter, disclosed herein in two forms, is configured to enable a golfer to strike the golf ball at an ideal location which eliminates torque action on the club and spinning action on the ball. Moreover, the weight distribution of the club is such that a large striking surface on the club head is provided in which only nominal or minimum torque action obtains in the event that the golfer strokes the ball at a location other than such ideal location. A further feature hereof resides in the ease by which proper alignment of the club and ball with the hole is achieved. To accomplish this and in one form of the present invention the club shaft is angled rearwardly of the club head and is offset forwardly of the face of the putter a distance preferably equal to the radius of the ball. Also, in that one form, the connection between the shaft and club head appears to the golfer when stroking the ball at right angles to the axis of the shaft and the striking surface of the club head. Thus, a symmetrical view is presented to the golfer which assists in accurately optically aligning the ball, club head and hole. Moreover, the present golf putter in both forms hereof is configured and its weight is distributed to achieve proper stroking motion and proper rolling of the ball.

The foregoing and other features are achieved in the provision of a golf club according to the present invention having a shaft, a club head, and a shank interconnecting the shaft and the club head. In one form, the shaft is spaced forwardly from the striking surface of the putting head substantially a distance equal to the radius of the golf ball and as is conventional inclines away from the club head. Preferably the axis of the shaft when extended will intersect the center of the ball when the ball is stroked by the club head. The lower portion of the shank angles rearwardly from the axis of the shaft and then to one side for connection with the heel portion of the club head. Consequently, when the club is viewed by the golfer when he addresses the golf ball, the axis of the shaft, when extended through the golf ball, and the striking face of the club head lie in parallel planes. The lower portion of the shank which interconnects the shaft and club head lies normal to such parallel planes and on the rear side of an oblique plane passing through the axis of the shaft normal to such planes. In this form, the club head per se is provided with a recess which opens through the bottom of the head. The recess is shifted slightly towards the heel of the club head whereby the center of gravity of the club head lies closer to the toe rather than the heel of the club head. This additional weight counterbalances the extra weight produced by the shank portion of the club rearwardly of the shaft axis. Thus, the club is balanced about the axis of the shaft and a ball properly stroked will be struck at a location along the striking surface in such oblique plane and at an elevation in the horizontal plane containing the center of gravity of the club head and consequently torquing action is eliminated. The weight distribution in the club head per se is such that the ends and top portion of the head are heavier than the intermediate lower portions thereof. Consequently, when the golf ball is struck at a location along the striking surface of the club head other than the aforedescribed ideal location, any resulting torque action is nominal and minimized.

In another embodiment of golf club disclosed herein, the shank and consequently the lower end of the shaft is offset forwardly of the putter head and from the face thereof. This allows the golfer a full symmetrical view of the head of the putter and faciliates proper alignment of the ball and putter with the hole. Also, it forces the hands of the golfer ahead of the putter head, thus forcing a pulling action by the golfer's hands through the ball to provide improved directional control. A recess is also provided and located off center toward the heel such that the weight of the putter head is greater at its toe as in the prior embodiment. In this embodiment, the placement of the cavity is determined by supporting the putter centrally of its grip and allowing it to hang free such that a vertical line passing through the center of the grip intersects the center of the putter head face and defines the "sweet spot". In this latter embodiment, an improved hitting surface is provided which assures uniform feel should the ball be struck off center to either side of the center line of the head, i.e., either side of the "sweet spot". To accomplish this, a second cavity is located just behind the club head face and extends equal distances to opposite sides of the club head center line providing a uniform face depth. Consequently the feel of the club is the same whenever the ball is struck at like distances on either side of the club head center line.

Accordingly, it is a primary object of the present invention to provide a novel and improved golf club.

It is another object of the present invention to provide a novel and improved golf putter which substantially eliminates torque action on the putter head upon stroking the golf ball.

It is still another object of the present invention to provide a novel and improved golf putter wherein the putter is balanced about the axis of the shaft.

It is related object of the present invention to provide a novel and improved golf putter wherein the head is provided with a downwardly opening cavity offset toward the heel of the club to weight the toe portion of the club head and thereby compensate for the additional weight of the shank rearwardly of the extended axis of the shaft whereby the club is balanced about the axis of its shaft.

It is a further object of the present invention to provide a novel and improved golf putter which provides for optical alignment of the club head, ball and hole by the symmetrical arrangement and configuration of the elements forming the golf putter as viewed by the golfer.

It is a still further object of the present invention to provide a novel and improved golf putter wherein the shaft is angled relative to the putting head such that its axis passes through the center of the ball with the putter head being spaced back a distance equal to the radius of the ball.

It is a related object of the present invention to provide a novel and improved golf putter wherein, in addition to the cavity located in the putter head to balance the club and weight the toe portion of the club head, a second cavity extends uniformly behind the club head for a like distance on opposite sides of the club centerline to improve the feel of the club when the ball is struck at a distance on either side of the club head center It is a further related object of the present invention to provide a novel and improved golf putter which is balanced such that the golf club, when hung free from the center of its grip, will have a vertical line intersecting the club head face and defining the "sweet spot".

These and further objects and advantages of the present invention will become more apparent upon reference to the following specification, appended claims and drawings wherein:

FIG. 1 is a perspective view of a golf putter constructed in accordance with the present invention and illustrating the head of the putter in contact with a golf ball;

FIG. 2 is a cross-sectional view therof taken generally about on line 2—2 in FIG. 1;

FIG. 3 is a fragmentary top plan view illustrating the golf head as the putter addresses the golf ball;

FIG. 4 is a fragmentary bottom plan view particularly illustrating the cavity in the golf putter;

FIG. 5 is a perspective view of another embodiment of golf putter constructed in accordance with the present invention and illustrating the manner in which the club is balanced;

FIG. 6 is an enlarged front elevational view of the club head illustrating the shank and connection portion of the shaft;

FIG. 7 is a rear elevational view of the club head illustrated in FIG. 6;

FIGS. 8 and 9 are end elevational views of the club head illustrated in FIG. 6 and taken respectively from the toe and heel sides thereof;

FIG. 10 is an enlarged top plan view of the club head; and

FIGS. 11*a*—11*e* are cross-sectional views thereof taken generally about on lines 11*a*—11*a*; 11*b*—11*b*; 11*c*—11*c*; 11*d*—11*d*; and 11*e*—11*e* in FIG. 6.

Referring now the the drawings, particularly to FIGS. 1-4, there is illustrated one form of a golf club, constructed in accordance with the present invention and generally designated 10, comprised of a putter head 12, a shaft 14 (FIG. 2) terminating in a grip or a handle 16 (FIG. 1) at the upper end of the shaft and a shank 18 interconnecting the lower end of shaft 14 and the putter head 12. For proper perspective, orientation and understanding of the present invention, a golf ball is illustrated at 20. The shaft 14, preferably formed of steel, angles rearwardly from the head of the club with the extended axis, designated A, of the shaft 14 intersecting the center of golf ball 20 when the golf ball is stroked properly as more particularly set forth in the ensuing description. The lower end of the shaft 14 is connected to the upper end of shank 18 by any suitable type connection. As illustrated in FIG. 1, the shank 18 is preferably formed of aluminum and inclines downwardly and rearwardly from its upper end rearwardly of axis A. More particularly, shank 18 lies in a plane containing the axis A of shaft 14 and which plane lies parallel to a plane containing the striking surface 22 of the putter head 12. The lower end or base 24 of shank 18 extends normal to both the aforedescribed planes containing shank 18 and extended axis A on the one hand and the striking surface 22 of head 12 for connection with a heel portion 28 of the club head 12.

Club head 12 is preferably formed of brass and is comprised of an elongated bar generally rectangular in cross-section and having a hollowed-out or recessed interior designated 26. Recess 26 opens through the bottom of the club head 12 as outlined by the solid line designated 27 in FIG. 4. As illustrated in both FIGS. 3 and 4, the endwise extremities of the recess lie outwardly of the end edges of the opening through the bottom of the club. For reasons noted more particularly hereinafter, recess 26 is offset toward the heel portion 28 of club head 12. This is best illustrated in FIGS. 3 and 4 where it will be observed that the toe portion 30 of club head 12 between the wall defining the outer end of recess 26 and the outer end wall of the club head is much thicker than the heel portion of the head 12 between the inner wall of the recess and the outer end wall surface. Consequently, the center of gravity of the club head per se is offset outwardly toward the toe portion 30 of the club head, the center of gravity of the club head being intersected by a transverse line designated 32 and which line as explained more fully hereinafter intersects the ball at a location outwardly of its center. By offsetting the recess toward the heel portion of the club head, and thereby allowing more weight in the toe portion of the club and shifting the center of gravity outwardly towards such toe portion, the extra weight produced by the portion of the shank 18 on the opposite side of an oblique plane containing the axis A normal to the previously mentioned planes is counterbalanced. Consequently, the club is balanced about the axis A of the shaft 14. For example, when the shaft 14 lies in a horizontal position, the club head will lie such that the striking surface 22 lies in a horizontal plane. This weight distribution ensures that the club is balanced about the axis of its shaft and that a ball properly stroked in the center of the club head, i.e., inset slightly from the transverse line 32 passing through the center of gravity of the club head as illustrated in FIG. 3, will be struck at the center of mass thereby eliminating any torque action on the putter head.

Also, the club head 12 is top weighted as is evident from the cross section of the club head illustrated in FIG. 2. The center of gravity of the club head in a vertical direction is thus intersected by the horizontal line 32 extending through the club head in FIG. 2. To provide such weight distribution, the top of the club head 12 inwardly of the heel and toe portions 28 and 30, respectively, is arcuately recessed as illustrated at 36. Additionally, the lower face of the club head, at a location intermediate the heel and toe portions 28 and 30, respectively, is recessed upwardly, for example a distance D of about 1/8 inch above the lower extremities of the heel and toe portions. This reduces drag resistance when stroking and also assists in locating the center of gravity of the club head about the median elevation of the club head. When the ball is properly stroked, the line 32 through the center of gravity passes through the center of the ball.

From the foregoing description of one form of the golf club hereof, it will be appreciated that a significant feature of the present invention resides in the configuration and weighting of the club to achieve a proper stroking action which affords proper rolling of the golf ball along a line predetermined by the golfer. For example, by weighting the extremities of the club head and by balancing the club about the axis A of the shaft when the shaft lies in a horizontal plane such that the striking surface 22 also lies in a horizontal plane, contact between the ball and the striking surface 22 of the club head at the designed contact point, i.e., at a location along the striking surface 22 in the oblique plane previously described and at an elevation coincident with the elevation of the center of gravity of the golf club head, totally eliminates any torque action. Furthermore, by such club configuration and weight distribution, particularly by weighting the extremities of the club head, any deviation of the point of contact between the striking surface 22 and the golf ball 20 from such ideal point of contact results in only nominal or minimum torquing action. The desired path of travel of the golf ball is thus substantially achieved notwithstanding striking the ball at a location along striking surface 22 other than its designed ideal point of contact therewith. That is, by weighting the club head at the opposite ends and balancing the club about the axis, a broader area of the striking surface 22 is provided which may contact the golf ball with only nominal or minimum torque action. In prior clubs not having weighted ends or a uniform weight distribution throughout the club head, the further the point of contact from the center of gravity of the club head the greater the torquing action and hence less accuracy is achieved. The present golf club, on the other hand, eliminates torque action when the ball is struck at the ideal designed location along the striking surface and minimizes such torquing action when the ball is struck at a location other than the designed location, whereby greater accuracy when stroking the golf ball is achieved.

A further feature of this form of the present invention resides in the particular configuration of the club. For example, the shaft and striking surface lie in parallel planes with the base 24 of the shank lying at right angles thereto as viewed by the golfer when addressing the golf ball. This provides a symmetrical optical alignment of the club head and ball whereby such symmetry assists in achieving proper contact between the club head and ball. Note that the shank 18 extends either along axis A or rearwardly thereof and thereby does not obstruct the view of the golfer as he aligns the club head with the ball prior to stroking.

While the axis of the shaft A is illustrated as passing through the center of the golf ball when the latter is stroked properly by the club hereof, the base 24 of the shank may be extended slightly to locate the axis A slightly ahead of the center of the ball. In this form, the shaft leads the head to afford a pulling action through the ball. The hands of the golfer will thus lead the shank and club head through the ball.

Referring now to the drawings and particularly to the embodiment of golf club illustrated in FIGS. 5–11 hereof, wherein like numerals represent similar parts as in the preceding embodiment with the suffix a added to differentiate the two embodiments, there is illustrated a putter, generally designated **10*a* having a putter head 12*a*, a shaft 14*a*, a grip or handle 16*a* at the upper end of the shaft, and a shank 18*a* interconnecting the lower end of the shaft and the putter head 12*a*. The golf club 10*a* may be formed of materials similarly as the golf club 10 illustrated in FIGS. 1–4 hereof. In this embodiment, the club head 12*a* is elongated and generally rectangular in cross section, and has a hollowed out or recessed interior designated 26*a*, which opens to the rear side of the club head opposite the club head face 22*a*. Recess 26*a* is offset toward the heel portion 28*a* of club head 12*a*, and consequently the center of gravity of the club head per se is offset outwardly toward the toe portion 30*a* of the club head as in the preceding embodiment. As noted previously, by offsetting the recess toward the heel portion of the club head, the extra weight produced by the shank 18*a* on the opposite side of an oblique plane containing the axis of the shaft is counterbalanced. In this form, the recess is more particularly located such that, when club 10*a* is suspended freely from a point P centrally located in the handle 16*a*, a vertical line will pass through and define a "sweet spot" S in the face of putter head 12*a*. That is, the correct placement of the recess 26*a* is determined by supporting the putter by its grip and allowing it to hang free. A true vertical line, for example by use of a plumb bob, would then cross or intersect the center of the head to define the "sweet spot", and this provides greater control of the ball when putted. As illustrated clearly in FIG. 6, the shank portion 18*a* and 14*a* 14a are offset from the face of the putter 10*a* and forwardly of the putter face. The location of the shaft and shank thus enables the golfer to have a full symmetrical view of the head of the putter, and this facilitates proper alignment of the ball and the putter with the hole. Also, this arrangement locates the hands of the golfer ahead of the putter head, thus forcing a pulling action by the golfer's hands through the ball which gives the ball a true roll and greater improved control over direction. As best illustrated in FIGS. 7 and 10, the upper face of the head 12*a* is recessed at 40 with the recess extending longitudinally along the top face of the club head like distances on opposite sides of the "sweet spot" S. A directional groove or line 42 is provided along the upper surface dividing recess 40 and which is in alignment with the "sweet spot"S. Also, a further recess 44 is provided through the club head 12*a* from top to bottom directly behind the putting face 22*a*. The recess 44 extends in opposite directions toward the heel and toe portions of the club head equal distances on opposite sides of the "sweet spot" S and extends the full depth of the club head opening through the top and bottom surfaces thereof. As illustrated in FIG. 10, the depth of the material between the face 22*a* of the putter head and the inside wall defining recess 44** is uniform thus assuring like reaction when the ball is struck off center to either side of the centerline or "sweet spot". This improves the golfer's ability to properly stroke and roll the ball by providing the same "feel" when the ball is struck off center.

As will be appreciated from a review of drawing FIGS. 5-11, the design of the club head itself, due to its use of multiple perpendicular lines, also facilitates optical alignment of the ball with the hole in addition to the foregoing noted features.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A golf club for stroking a golf ball comprising an elongated shaft, a head having a flat surface for striking a golf ball and a shank connecting one end of said shaft and said head, said shaft having an axis forwardly of and in a plane generally parallel to and spaced forwardly a predetermined distance from a plane containing said striking surface so that the axis extended is adapted to intersect a golf ball when said head lies in striking position relative to the ball, said shank extending from said shaft for connection with the striking surface of said head at a heel portion thereof, said head having a cavity opening downwardly through the bottom face of said head, the cavity being offset toward the heel portion of said head to provide a greater weight in the toe portion of said head than in the heel portion thereof, thereby shifting the center of gravity of the head towards said toe portion the connecting portion of said shank and the heel portion of said head lying on one side of an oblique plane containing the axis of said shaft and extending normal to a plane containing said striking surface, the toe portion of said head and the center of gravity of said head lying on the other side of said oblique plane, the cavity being so located to balance the club about the shaft axis such that when the shaft lies in a horizontal position the club head will be so oriented that the striking face lies in a horizontal plane;

said head further including a recess formed along its upper face and a side face thereof remote from said striking surface, and spaced midway between the heel and toe portion of said head the recess locating the center of gravity of said head above the median of the head height;

the bottom face of said head being recessed between its heel and toe portions so that drag resistance during stroking is minimized.

2. A golf club according to claim 1 wherein the connecting portion of said shank extends normal to said striking surface with the remaining portion of said shank lying in the first-mentioned plane.

3. A club according to claim 2 wherein a portion of said shank inclines upwardly from the connecting portion thereof toward said shaft and lies on the same side of said oblique plane as the heel portion of said head.

4. A golf club according to claim 1 wherein said head is formed of a heavier material than the material forming said shank.

5. A golf club according to claim 4 wherein said head is formed at least in part of brass and said shank is formed at least in part of aluminum.

* * * * *

UNITED STATES PATENT AND TRADEMARK OFFICE

CERTIFICATE OF CORRECTION

PATENT NO. : 3,967,826

DATED : July 6, 1976

INVENTOR(S) : Clay Judice

It is certified that error appears in the above-identified patent and that said Letters Patent are hereby corrected as shown below:

Col. 3, line 15, insert period --.-- after "center".
Col. 6, line 30, "and 14a" should read --and shaft 14a--;
line 30, delete "14a" second occurrence.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*